US006887086B2

(12) United States Patent
Kuroki

(10) Patent No.: US 6,887,086 B2
(45) Date of Patent: May 3, 2005

(54) SHUTTERED CONNECTOR

(75) Inventor: Yoshihide Kuroki, Tachikawa (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/627,263

(22) Filed: Jul. 25, 2003

(65) Prior Publication Data

US 2004/0067667 A1 Apr. 8, 2004

(30) Foreign Application Priority Data

Aug. 7, 2002 (JP) ..... 2002-230335

(51) Int. Cl.[7] ..... H01R 13/44
(52) U.S. Cl. ..... 439/138
(58) Field of Search ..... 439/138, 137, 439/135, 607, 142

(56) References Cited

U.S. PATENT DOCUMENTS

| | | | | |
|---|---|---|---|---|
| 3,219,964 | A * | 11/1965 | De Penti | 439/138 |
| 6,454,580 | B1 * | 9/2002 | Hwang | 439/138 |
| 2001/0000764 | A1 * | 5/2001 | Chow et al. | 439/137 |
| 2001/0031570 | A1 * | 10/2001 | Horikoshi et al. | 439/137 |

FOREIGN PATENT DOCUMENTS

| | | |
|---|---|---|
| JP | 654260 | 7/1994 |
| JP | 11008010 | 1/1999 |
| JP | 11-260459 | 9/1999 |
| JP | 2001-313115 | 11/2001 |
| JP | 2003-229201 | 8/2003 |

* cited by examiner

*Primary Examiner*—P. Austin Bradley
*Assistant Examiner*—Felix O. Figueroa
(74) *Attorney, Agent, or Firm*—Collard & Roe, P.C.

(57) ABSTRACT

A shuttered connector including a fitting part that receivee a mating connector including an insertion part having a slanted surface, an insulator, at least one shutter that is rotatably supported by and fixed on the insulator, and helical springs that continuously urge the shutter in the closing direction. The shutter is selectively closed state when the shutter covers the fitting part and in an opened state when the mating connector is capable of being fitted with the shuttered connector. The mating connector includes insertion parts. The shutter further includes a guide units having an inclined surface, the shutter being rotated to open outward, with the including surface being pushed by slanted surface when the fitting part receives the mating connector so that the shutter connector is capable of fitting the mating connector.

10 Claims, 9 Drawing Sheets

SHUTTERED CONNECTOR

The present application claims priority to prior Japanese application JP 2002-230335, the disclosure of which is incorporated herein by reference.

BACKGROUND OF THE INVENTION

The present invention relates to a shuttered connector, the shuttered connector having at least one shutter or at least one door at a fitting part which fits with a mating connector.

Contact portions or contacts for electrical connection in interface connectors are used for commonly used apparatuses including electric circuits, and are exposed to the surrounding environment. Thus, materials, such as dust and dirt, may adhere to the contact portions and such materials have electrical influence on the contact portions. Also, a coin and the like may enter the contact portions and such objects are likely to physically damage the contact portions.

Caps called dust caps are mainly used in conventional technologies in order to prevent dust, dirt, and the like from entering the contact portions and to prevent the resulting damage to the contact portions.

Since, however, the dust caps must be used when connectors are disconnected and the dust caps must be removed for connection, the use of the dust caps causes trouble and inconvenience.

Therefore, it is also suggested that at least one shutter is provided at a connector fitting part of a casing.

Descriptions will be made as regards a connector system disclosed in Japanese Unexamined Patent Application Publication No. 11-8010 (hereinafter, referred to as conventional technology 1).

The connector system includes a pair of connectors composed of a main unit side connector provided in an electronic apparatus main unit and a connecting side connector. The connector system is used for connection to transmit signals between electronic apparatuses. An exterior case of the electronic apparatus main unit has an opening for receiving the connecting side connector. Dustproof shutters are provided at the opening and the shutters are opened and closed perpendicular to the insertion direction of the connecting side connector. The connecting side connector has guide members for fitting with the main unit side connector. The guide members and the shutters have tapered parts. The tapered parts slide and contact each other and thus produce thrust to make the shutters move in the corresponding opening directions when the connecting side connector is inserted into the opening of the electronic apparatus main unit.

Next, descriptions will be made as regards an electric connector disclosed in Japanese Unexamined Utility Model Registration Application Publication No. 6-54260 (hereinafter, referred to as conventional technology 2). The electric connector includes a mold base and a shielding case that covers the mold base. The front end of the mold base has an insertion opening, and the front end of a socket type mating connector is fitted into the insertion opening. Also, contacting members are arranged so as to face into the insertion opening. Shutters for opening and closing the insertion opening are made of conductive materials and are connected to the front end of the shielding case with hinges. Helical torsion springs are provided at the front end of the shielding case so as to continuously urge the shutters in the corresponding closing directions. Accordingly, the shutters and the shielding case are electrically connected to each other.

In conventional technologies 1 and 2, however, precise adjustment of the positional relationship between the shutters and the mating connector is impossible at the stage of apparatus assembling. Thus, a long fitting stroke is needed to allow for adjustment. In this event, the size of the connectors is increased.

SUMMARY OF THE INVENTION

Accordingly, it is an object of the present invention to provide a shuttered connector that saves a user from inconvenience of putting on and removing a cap and that prevents the user from forgetting to close a shutter by automatically opening and closing the shutter when fitting.

It is another object of the present invention to provide a shuttered connector that reduces the size of connectors by increasing the accuracy of the positional relationship between a mating connector and a shutter.

It is still another object of the present invention to provide a shuttered connector that simplifies apparatus assembling after delivery by modularizing parts.

According to the present invention, there is provided a shuttered connector which includes a fitting part that receives a mating connector, an insulator, at least one shutter, and elastic members (for example, helical springs). The shutter is rotatably supported by and fixed on the insulator. The shutter moves between a closed position at which the shutter covers the fitting part and an opened position at which the mating connector is capable of being fitted with the shuttered connector. The elastic members continuously urge the shutter in the closing direction. The shutter includes guide units and the mating connector includes insertion parts. The insertion parts and the guide units cooperate to rotate the shutter in order to open the shutter so that the mating connector is capable of being fitted with the shuttered connector.

In the present invention, it is preferable that the shutter include one shutter plate. The shutter plate may open in the direction orthogonal to the fitting direction of the mating connector.

Furthermore, in the present invention, it is preferable that two shutters include corresponding shutter plates. The shutter plates may open upward and downward, and may close by butting the ends of the shutter plates together.

DESCRIPTION OF THE PREFERRED EMBODIMENTS

In order to facilitate an understanding of the present invention, electric connectors according to conventional technologies will be described before explaining the embodiments of the present invention with reference to FIGS. 1 to 3.

Figure 1:
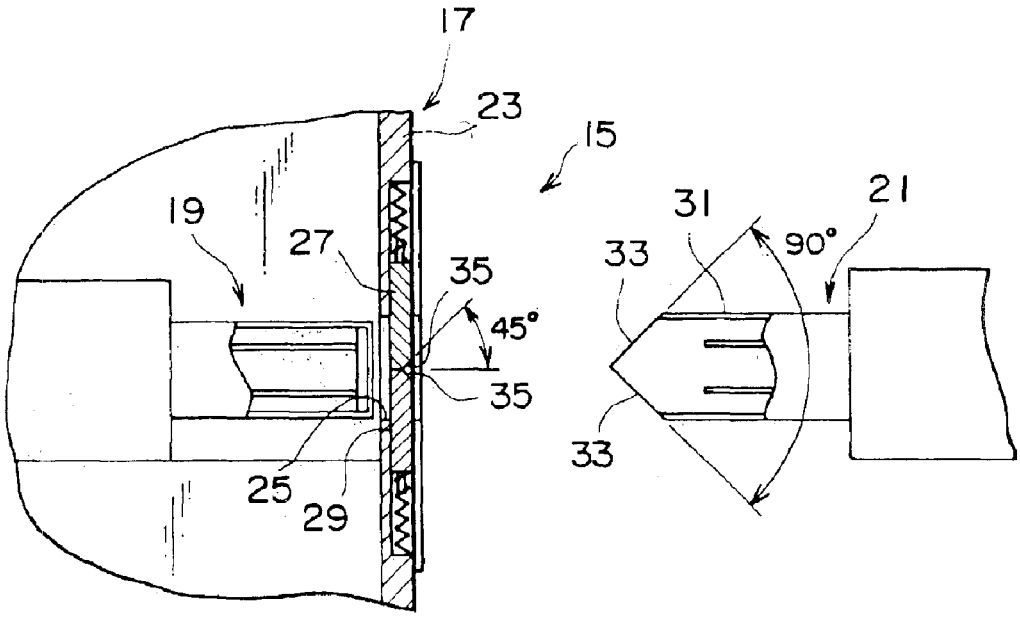
FIG. 1 PRIOR ART
FIG. 1 is a sectional view of an electronic apparatus connector system according to conventional technology 1.

Referring to FIG. 1, a connector system 15 according to conventional technology 1 includes a pair of connectors composed of a main unit side connector 19 provided in an electronic apparatus main unit 17 and a connecting side connector 21. The connector system 15 is used for connection to transmit signals between electronic apparatuses. An exterior case 23 of the electronic apparatus main unit 17 has an opening 25 for receiving the connecting side connector 21. Dustproof shutters 27 and 29 are provided at the opening 25 and the shutters 27 and 29 are opened and closed perpendicular to the insertion direction of the connecting side connector 21. The connecting side connector 21 has guide members 31 for fitting with the main unit side connector 19. The guide members 31 and the shutters 27 have tapered parts 33 and 35, respectively. The tapered parts 33 and 35 slide and contact each other and thus produce thrust to make the shutters move in the corresponding opening directions when the connecting side connector 21 is inserted into the opening 25 of the electronic apparatus main unit 17.

Figure 2:
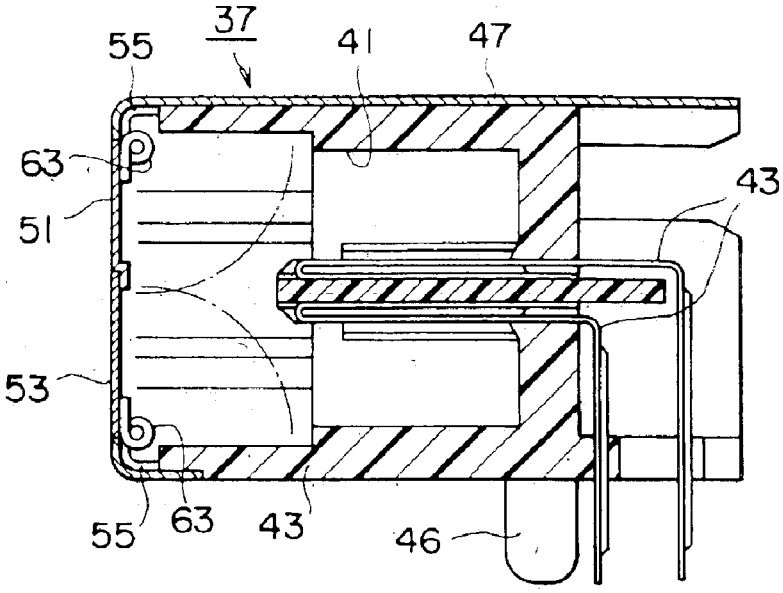
FIG. 2 PRIOR ART
FIG. 2 is a sectional view of an electric connector according to conventional technology 2.
Figure 3:
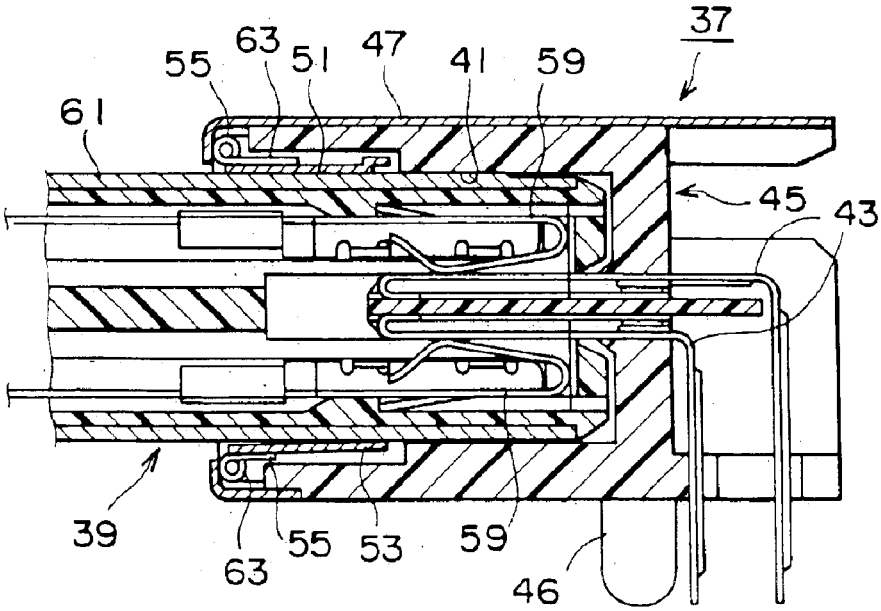
FIG. 3 PRIOR ART
FIG. 3 is a sectional view showing a state in which the electric connector shown in FIG. 2 is fitted with a mating connector.

Referring now to FIGS. 2 and 3, the front end of an electric connector 37 according to conventional technology 2 has an insertion opening 41, and the front end of a socket type mating connector 39 (hereinafter, referred to as a mating connector 39) is fitted into the insertion opening 41. The electric connector 37 also includes a mold base 45 and a shielding case 47 that covers the mold base 45. The mold base 45 has contacting members 43 which are arranged so as to face into the insertion opening 41. Shutters 51 and 53 for opening and closing the insertion opening 41 are made of conductive materials and are connected to the front end of the shielding case 47 with hinges 63. Also, helical torsion springs 55 are provided at the front end of the shielding case 47 so as to continuously urge the shutters 51 and 53 in the corresponding closing directions. Accordingly, the shutters 51 and 53 and the shielding case 47 are electrically connected to each other.

In the electric connector 37 according to conventional technology 2 with the structure described above, as shown in FIG. 3, the mating connector 39 is fitted into the insertion opening 41 and the leading end of the mating connector 39 pushes the shutters 51 and 53. Thus, the shutters 51 and 53 are inwardly opened in the upward and downward direction, respectively, against the elastic force of the helical torsion springs 55.

Pushing the mating connector 39 deeply into the insertion opening 41 causes contacting members 59 provided within the mating connector 39 to contact the contacting members 43 of the electric connector 37 and thus to be electrically connected to the contacting members 43. Also, pushing the mating connector 39 deeply into the insertion opening 41 causes the shutters 51 and 53 to elastically press-contact a shielding case 61 that covers the mating connector 39.

Therefore, static electricity and the like on the mating connector 39 move from the shutters 51 and 53 to the shielding case 61 through the hinges 63 and thus are discharged to the outside.

As described above, according to conventional technology 2, the shutters 51 and 53 prevent foreign matter or dust from entering the insertion opening 41, thus considerably preventing malfunction. Also, since the shutters 51 and 53 serve as contact terminals that elastically press-contact the mating connector 39, the shielding case 61 does not need to have any contact terminal.

The embodiments of the present invention will now be described with reference to the drawings.

Figure 4:
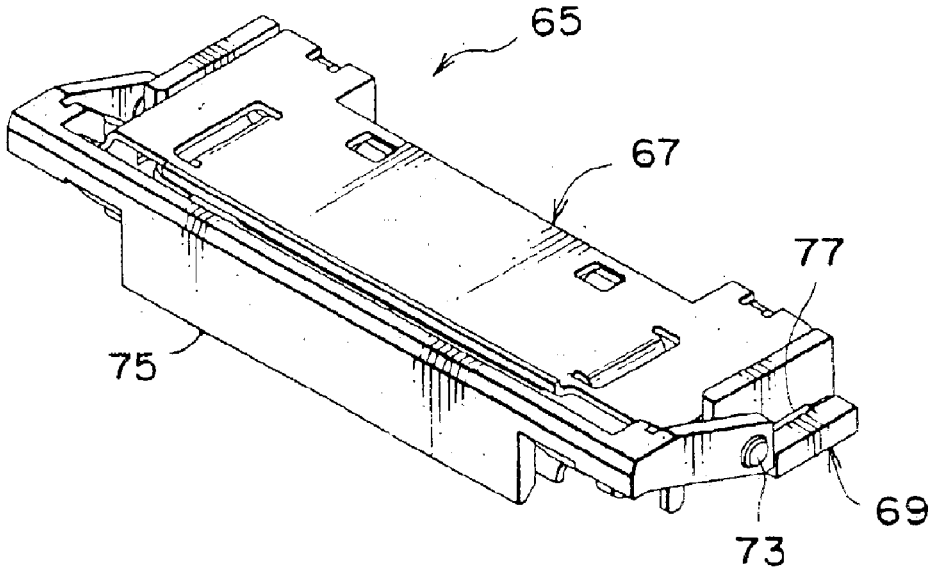
FIG. 4 is a perspective view showing the appearance of an entire shuttered connector according to a first embodiment of the present invention when a shutter is closed.
Figure 5:
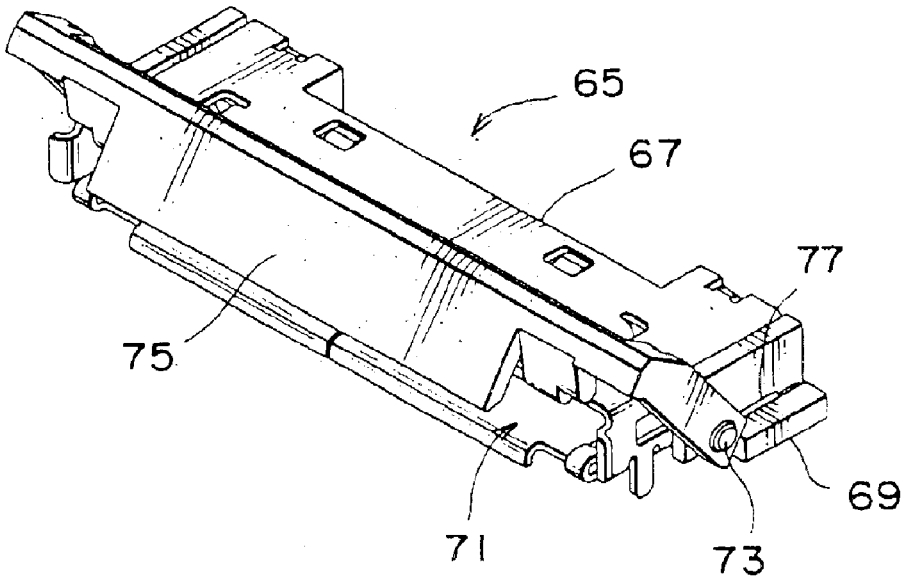
FIG. 5 is a perspective view of the shuttered connector shown in FIG. 4 when the shutter is opened.
Figure 6A:
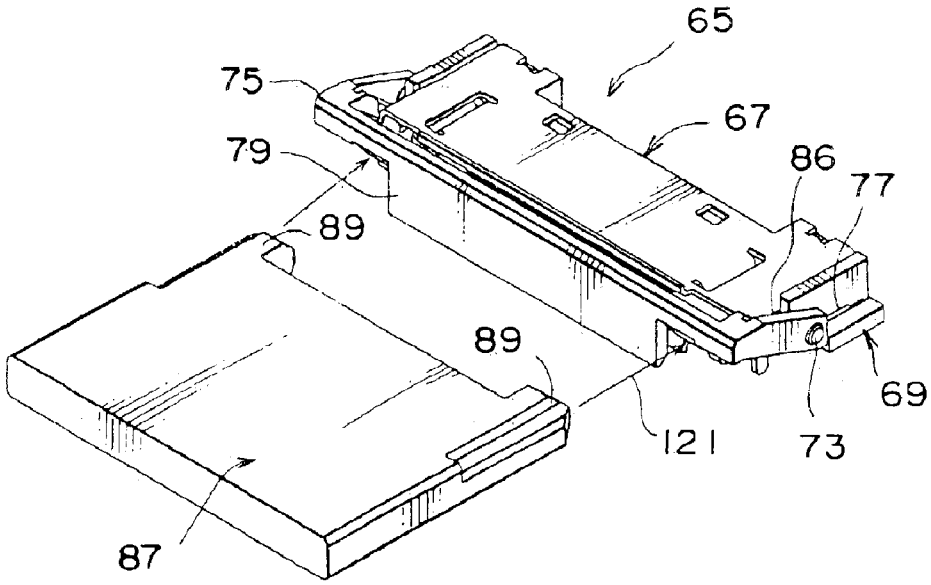
FIG. 6A is a perspective view of the shuttered connector shown in FIGS. 4 and 5 and a mating connector for explaining the fitting operation and shows a state before fitting of the shuttered connector and the mating connector.
Figure 6B:
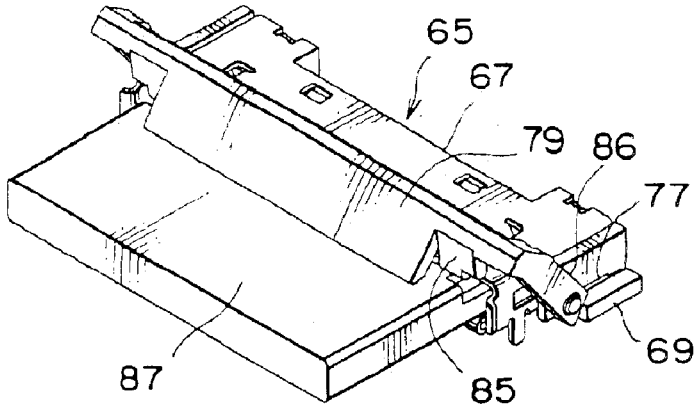
FIG. 6B is a perspective view of the shuttered connector shown in FIGS. 4 and 5 and the mating connector for explaining the fitting operation and shows a state in which the mating connector is fitted with the shuttered connector.
Figure 7A:
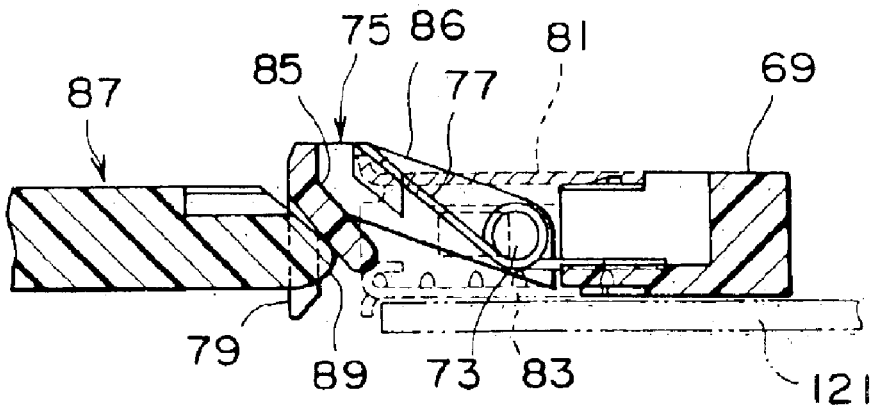
FIG. 7A is a sectional view of the shuttered connector shown in FIGS. 4 and 5 and the mating connector for explaining the fitting operation and shows the state before fitting of the shuttered connector and the mating connector.
Figure 7B:
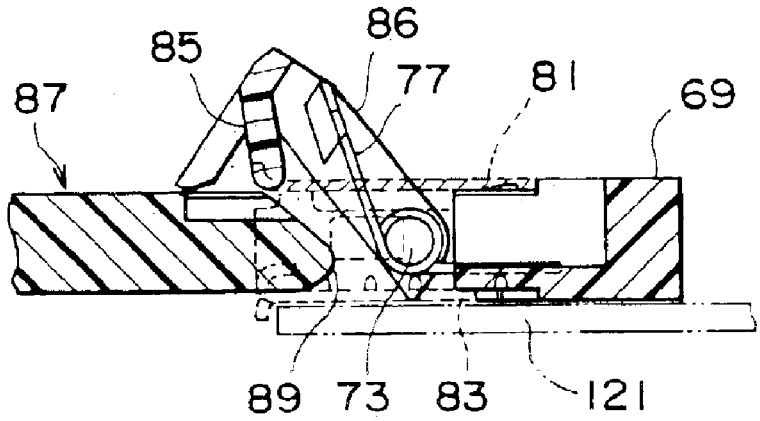
FIG. 7B is a sectional view of the shuttered connector shown in FIGS. 4 and 5 and the mating connector for explaining the fitting operation and shows the state in which the mating connector is fitted with the shuttered connector.

Referring to FIGS. 4 and 5, a connector 65 with a shutter (hereinafter, referred to as a shuttered connector 65) includes a box-type insulator 69, a shutter 75, and springs 77. The upper and lower surfaces of the insulator 69 are covered with upper and lower metal shells 67. A shaft 73 is fitted with bosses provided at sides of the insulator 69. The shutter 75 is provided at the front of the shuttered connector 65 and opens upward by rotating around the shaft 73. The springs 77 function as elastic members and urge the shutter 75 in the closing direction. Also, a plurality of contacts (not shown) is provided inside the insulator 69. The contacts are similar to contacts that will be described in a description of a third embodiment of the present invention. At the time of fitting, the contacts are brought into contact with corresponding contacts of a mating connector.

The front center of the lower shell 67 curls downward and has a part leading to a fitting part 71 to be fitted with the mating connector. Also, both sides of the front end of the lower shell 67 curl upward and have springs protruding backward. When fitting, the mating connector is press-contacted between the upper and lower shells 67 by the springs.

Referring to FIGS. 6A, 6B, 7A, and 7B, the front surface of the shutter 75 has a shutter plate 79 and tilt guide units 85. The guide units 85 are provided at both sides of the shutter plate 79 and protrude a little obliquely backward with respect to the shatter plate 79. With this structure, the shutter 75 does not open if an object accidentally hits the shutter 75.

A mating connector 87 is a rectangular board. Both sides of the front end of the mating connector 87 have forward protruding insertion parts 89. The front portions of the upper surfaces of the insertion parts 89 are tilted and the lower front ends of the insertion parts 89 are rounded. An opening is provided between the insertion parts 89 and contacts are provided behind the opening, as will be described in the description of the third embodiment of the present invention.

As shown in FIGS. 6A, 6B, 7A, and 7B, when the mating connector 87 and the insertion parts 89 are inserted into the fitting part 71 and the guide units 85, respectively, the guide units 85 are disposed at both sides of the shutter plate 79 of the shutter 75 of the shuttered connector 65 and are brought into contact with the upper slant surfaces at the front ends of the insertion parts 89. Further insertion of the mating connector 87 causes the slant surfaces of the insertion parts 89 to push the guide units 85 upward. Thus, the shutter 75 is rotated around the shaft 73 against the resisting force of the springs 77 and is pushed upward.

When the slant surfaces of the insertion parts 89 push the guide units 85 until they become out of contact, the return force of the springs 77 rotates the shutter 75 around the shaft 73 in the closing direction. The front end of the shutter plate 79 hits against the upper surface of the mating connector 87 to stop the rotation. Accordingly, the mating connector 87 is connected to the shuttered connector 65.

For removing the mating connector 87, the mating connector 87 is pulled out of the fitting part 71. In this case, the return force of the springs 77 causes the shutter 75 to rotate downward around the shaft 73 to be closed.

Figure 8:
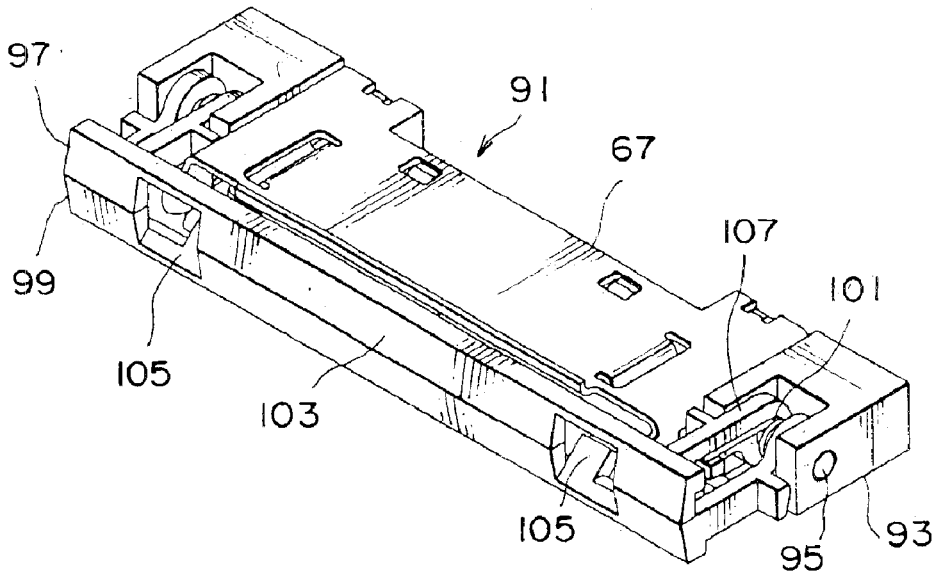
FIG. 8 is a perspective view showing the appearance of an entire shuttered connector according to a second embodiment of the present invention when shutters are closed.
Figure 9:
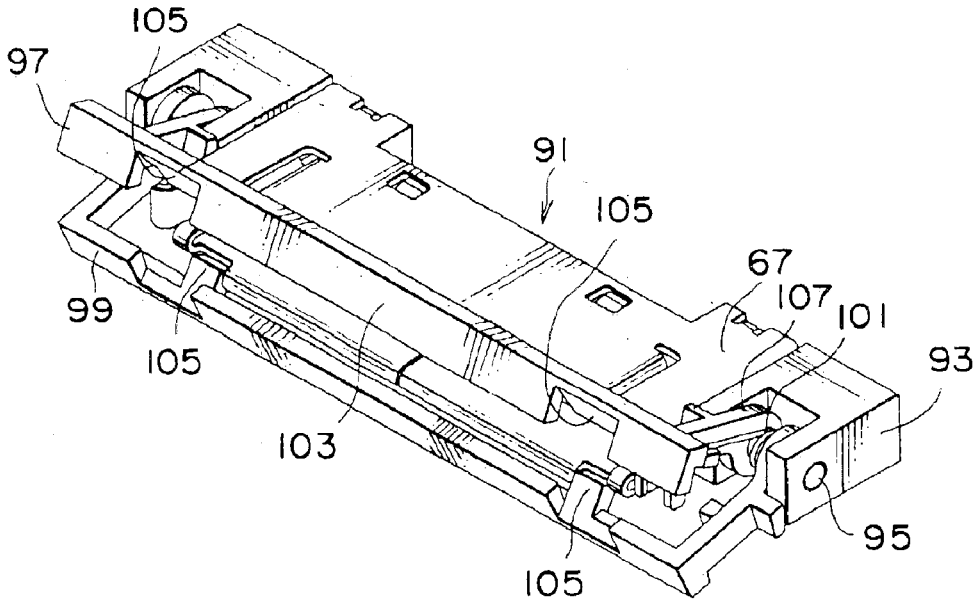
FIG. 9 is a perspective view of the shuttered connector shown in FIG. 8 when the shutters are opened.
Figure 10A:
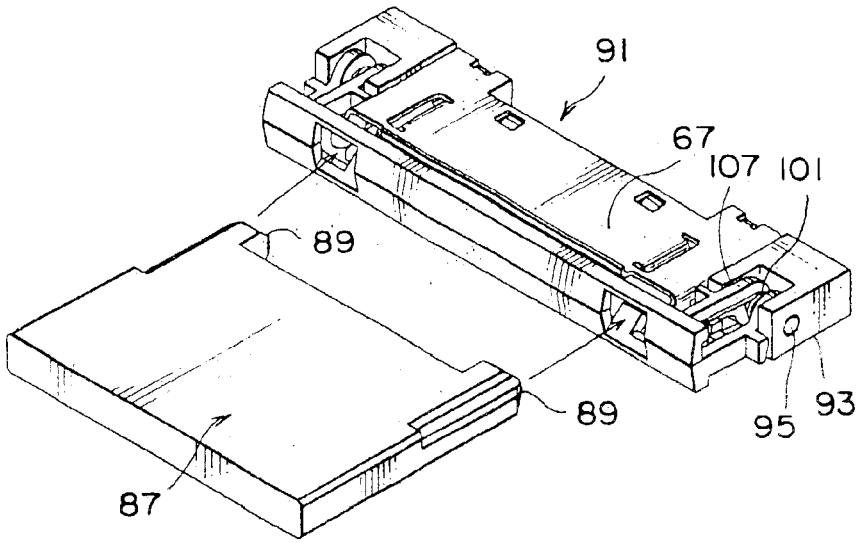
FIG. 10A is a perspective view of the shuttered connector shown in FIGS. 8 and 9 and a mating connector for explaining the fitting operation and shows a state before fitting of the shuttered connector and the mating connector.
Figure 10B:
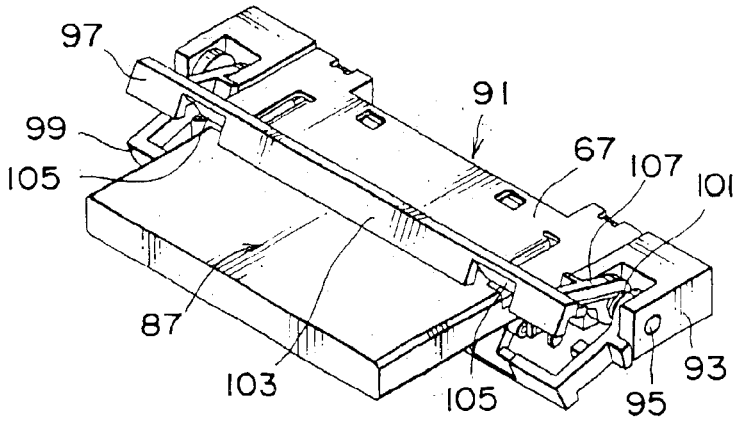
FIG. 10B is a perspective view of the shuttered connector shown in FIGS. 8 and 9 and the mating connector for explaining the fitting operation and shows a state in which the mating connector is fitted with the shuttered connector.
Figure 11A:
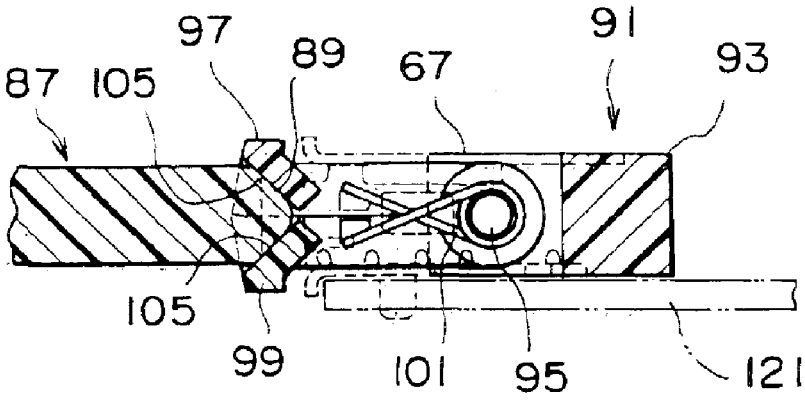
FIG. 11A is a sectional view of the shuttered connector shown in FIGS. 8 and 9 and the mating connector for explaining the fitting operation and shows the state before fitting of the shuttered connector and the mating connector.
Figure 11B:
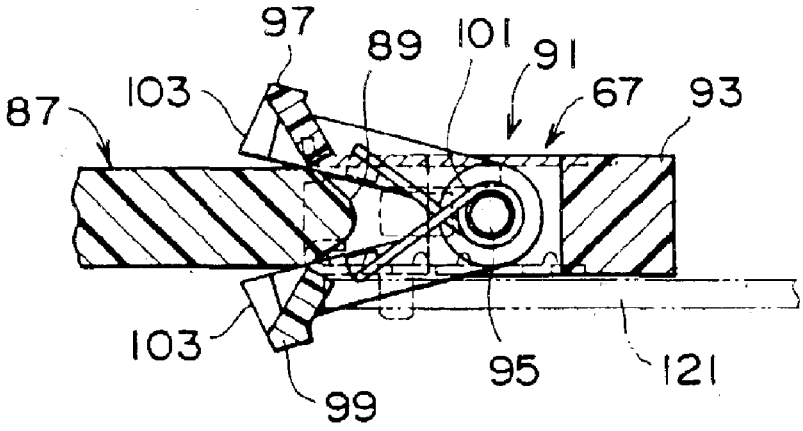
FIG. 11B is a sectional view of the shuttered connector shown in FIGS. 8 and 9 and the mating connector for explaining the fitting operation and shows the state in which the mating connector is fitted with the shuttered connector.

Referring now to FIGS. 8 and 9, a connector 91 with shutters (hereinafter, referred to as a shuttered connector 91) according to a second embodiment of the present invention includes a box-type insulator 93, a first shutter 97, a second shutter 99, and springs 101. The upper and lower surfaces of the insulator 93 are covered with the upper and lower metal shells 67. The first shutter 97 and the second shutter 99 are provided at the front of the shuttered connector 91 and open by rotating upward and downward, respectively, around a shaft 95. The springs 101 urge the first shutter 97 and the second shutter 99 to rotate in the corresponding closing directions. The insulator 93 has contacts that will be described in the description of the third embodiment of the present invention.

The front center of the lower shell 67 curls downward and has a part leading to the fitting part 71 to be fitted with the mating connector 87.

The front surface of each of the first shutter 97 and the second shutter 99 has a shutter plate 103, plate-type guide units 105, and arms 107. The guide units 105 are provided at both sides of the shutter plates 103 and protrude a little obliquely backward with respect to the shutter plates 103. The arms 107 are provided at both sides the first shutter and the second shutter 99. The shaft 95 penetrates the front ends of the arms 107 so that the arms 107 can rotate around the shaft 95.

The mating connector 87 is a rectangular board and is covered with metal-plate shells. The forward protruding insertion parts 89 are provided at both sides of the front end of the mating connector 87. An opening as in the third embodiment is provided between the insertion parts 89. Contacts are provided behind the opening and make contact with contacts (not shown) of the shuttered connector 91. The insertion parts 89 are wedge-shaped. The upper and lower surfaces and the outer surfaces of the insertion parts 89 are tilted and the front end thereof is rounded.

Referring now to FIGS. 10A, 10B, 11A, and 11B, the mating connector 87 is inserted into the fitting part 71, the guide units 105 are disposed at both sides of the shutter plates 103 of the first shutter 97 and the second shutter 99 of the shuttered connector 91 and are brought into contact with the upper and lower slant surfaces at the front ends of the insertion parts 89. Further insertion of the mating connector 87 causes the slant surfaces of the insertion parts 89 to push the guide units 105 upward and downward. Thus, the first shutter 97 and the second shutter 99 rotate upward and downward, respectively, to be opened around the shaft 95 against the resisting force of the springs 101 functioning as elastic members. The insertion parts 89 are sandwiched between the upper and lower shells 67 to be fixed. When the slant surfaces push the guide units 105 upward until they become out of contact, the return force of the springs 101 causes the front ends of the shutter plates 103 of the first shutter 97 and the second shutter 99 to be maintained to hit against the upper surface and the lower surface of the mating connector 87, respectively. Accordingly, the mating connector 87 is connected to the shuttered connector 91.

For removing the mating connector 87, the mating connector 87 is pulled out of the fitting part 71. In this case, the return force of the springs 101 causes the first shutter 97 and the second shutter 99 to rotate toward the closing positions to be closed.

Figure 12:
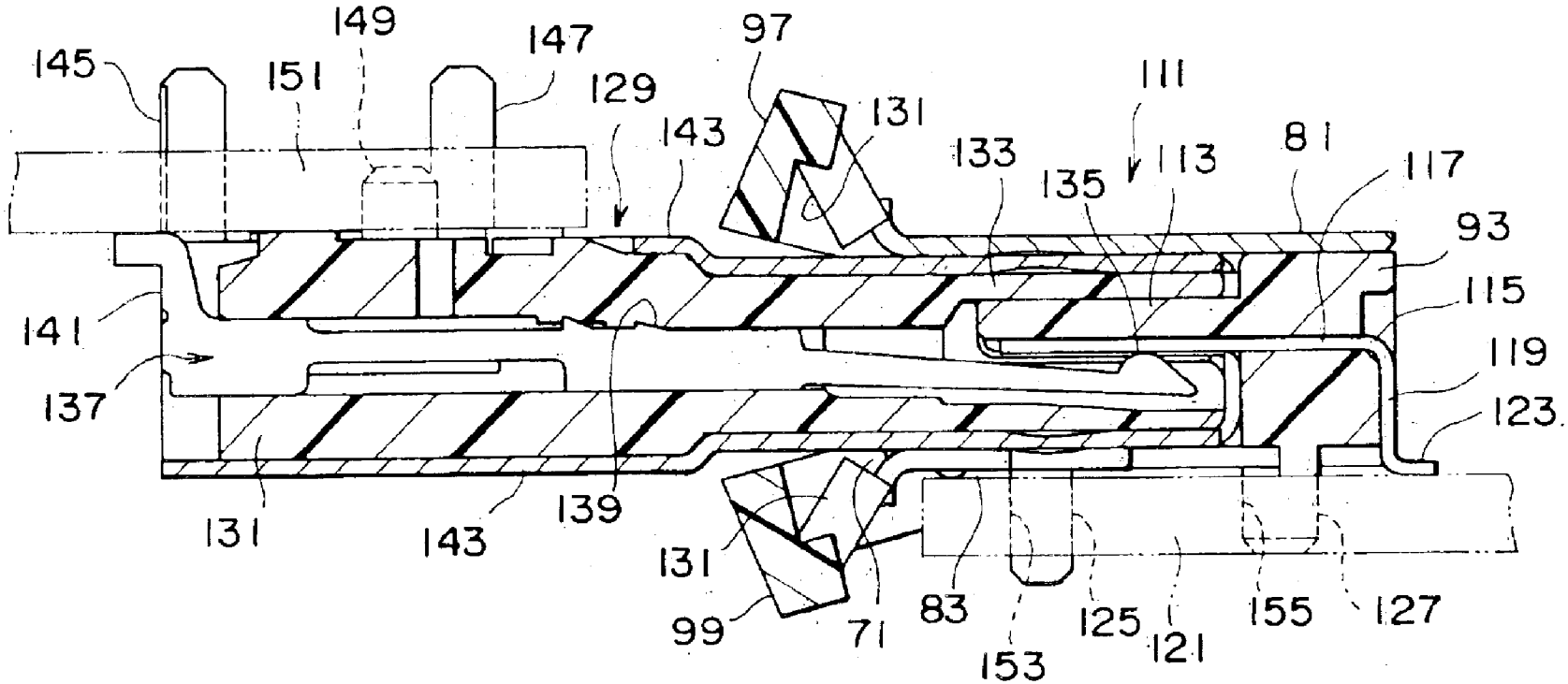
FIG. 12 is an illustration showing a shuttered connector according to a third embodiment of the present invention.

Referring now to FIG. 12, a connector 111 with shutters (hereinafter, referred to as a shuttered connector 111) according to the third embodiment of the present invention includes the box-type insulator 93, the first shutter 97, and the second shutter 99. The upper and lower surfaces of the insulator 93 are covered with a metal upper shell 81 and a metal lower shell 83, respectively. The first shutter 97 and the second shutter 99 open upward and downward, respectively, by rotating around the shaft (refer to FIGS. 8 to 11B), as in the first or second embodiment. The springs 101 urge the first shutter 97 and the second shutter 99 in the corresponding closing directions, as in the second embodiment.

Also, the insulator 93 has a protruding piece 113 protruding toward the front of the shells. A contact 115 includes a contacting part 117 provided along the lower surface of the protruding piece 113, a supported part 119 penetrating the insulator 93 and supported by the insulator 93, and a terminal 123 connected to a substrate 121. The front center of the lower shell 83 curls downward and has a part leading to the fitting part 71 to be fitted with a mating connector 129. Reference numerals 125 and 127 represent positioning pins for positioning on the substrate 121.

The mating connector 129 includes an insulator 131 and a contact 137. The contact 137 has a contacting part 135. The contacting part 135 protrudes in an opening 133 at the front end of the insulator 131. The contact 137 further includes a supported part 139 supported by the insulator 131 and a terminal 141 connected to an electrically conductive pattern and the like of a substrate.

The circumference of the insulator 131 is covered with metal shells 143.

Reference numerals 145, 147, and 149 represent pins for positioning on the substrate.

An operation is carried out in which the shuttered connector 111 is fitted with the mating connector 129 shown in FIG. 12 in a similar manner being described in the second embodiment of the present invention. More specifically, the opening 133 of the mating connector 129 is fitted with the protruding piece 113 of the insulator 93, the contacting part 117 of the contact 115 is placed on the lower surface of the protruding piece 113 and is subjected to pushing the contacting part 135 of the contact 137 downward. The elastic force of the pushed contact 137 causes the contacting part 135 to make contact with the contact 137 so that they are connected to each other.

In contrast, for removing the mating connector 129, the mating connector 129 is pulled out of the fitting part 71. In this case, the return force of the springs (not shown) causes the first shutter 97 and the second shutter 99 to rotate toward the original positions to be closed.

As described above, according to the first to third embodiments of the present invention, automatically opening and closing at least one shutter in the process of connection eliminates inconvenience for a user to put on and remove a cap.

Also, according to the first to third embodiments of the present invention, installing at least one shutter on a connector achieves a high-precision positional relationship between the shutter and the connector main unit, thus reducing the size.

As described above, according to the present invention, at least one shutter is automatically opened and closed in the process of fitting. This eliminates inconvenience for a user to put on and remove a cap, and prevents the user from forgetting to close the shutter. Also, a shutter mechanism is installed, not on a casing, but on a connector main unit. Thus, precision of the positional relationship between the shutter and a mating connector is increased. Consequently, the size of the connectors can be reduced.

Also, according to the present invention, a shuttered connector that simplifies apparatus assembling after delivery is provided by installing a shutter mechanism on a connector main unit, in other words, by modularizing parts.

What is claimed is:

1. In combination, a shuttered connector and a mating connector connected to each other in a predetermined direction, said mating connector including an insertion part having a slanted surface slanted relative to said predetermined direction, the shuttered connector comprising;

a fitting part that receives the mating connector;

an insulator;

a shutter rotatably supported by a pair of shafts provided at both sides of the insulator between a closed position at which the shutter covers the fitting part and an opened position at which the mating connector is capable of being fitted with the shuttered connector; and elastic members that continuously urge said shutter in a closing direction, said shutter including a guide unit having an inclined surface inclined relative to said predetermined direction, said shutter being rotated to open outwards, with said inclined surface being brought into contact with said slanted surface so as to be pushed by said slanted surface when said fitting part receives said mating connector, so that said shuttered connector is capable of fitting said mating connector and wherein said shutter has a two-plates structure having two shutter plates, the shutter plates having two common shafts consisting of the pair of shafts at the both sides of the shutter plates, respectively, and moving upward and downward around said two common shafts, respectively to open and butting the ends of the shutter plates together to close.

2. The combination according to claim 1, wherein at least one of the shutter plate opens in a direction orthogonal to a fitting direction of the mating connector.

3. The combination according to claim 1, wherein the mating connector has an insertion part and the insertion part has two portions protruding from front ends of both sides of the mating connector.

4. The combination according to claim 1, wherein said shutter further includes arms at both sides of at least one of said shutter, the arms reaching the insulator, one end of each of the arms being rotatably supported by the insulator.

5. The combination according to claim 1, wherein the fitting part of the shuttered connector is part of shells arranged at least at upper and lower surfaces of the insulator so as to cover ends of the insulator, the mating connector being sandwiched between the shells in a vertical direction.

6. The combination according to claim 5, wherein the shells are joined to a substrate.

7. The combination according to claim 1, further comprising socket contacts located in positions corresponding to mating contacts for making contact with the mating connector, wherein the mating connector further comprises a plurality of mating contacts located in positions different from the insertion part and aligned in a width direction.

8. The combination according to claim 1, wherein the mating connector is mounted on a substrate.

9. The combination according to claim 1, wherein the elastic members are made of springs.

10. The combination according to claim 1, wherein the inclined surface is flat.

* * * * *